United States Patent [19]

Buchschmid et al.

[11] Patent Number: 4,561,410

[45] Date of Patent: Dec. 31, 1985

[54] MAGNETO IGNITION UNIT WITH CONTROL CIRCUIT POTTED TOGETHER WITH THE ARMATURE WINDINGS, FOR INTERNAL COMBUSTION ENGINES

[75] Inventors: Emil Buchschmid, Rosstal; Lothar Gademann, Rottenburg; Adam Hirt, Ammerndorf; Manfred Hüttinger, Oberasbach; Hans P. Jahn, Dliezhausen; Josef Orova, Schwabach; Hans-Dieter Schmid, Nuremberg; Horst-Günter Steffen, Schwarzenbruck, all of Fed. Rep. of Germany

[73] Assignee: Robert Bosch GmbH, Stuttgart, Fed. Rep. of Germany

[21] Appl. No.: 724,079

[22] Filed: Apr. 17, 1985

[30] Foreign Application Priority Data

Apr. 18, 1984 [DE] Fed. Rep. of Germany ..... 3414691

[51] Int. Cl.[4] ..... F02P 1/08; F02P 3/08

[52] U.S. Cl. ..... 123/599; 123/149 D; 123/647

[58] Field of Search ..... 123/149 R, 149 A, 149 C, 123/149 D, 599, 601, 602, 647

[56] References Cited

U.S. PATENT DOCUMENTS

| | | | |
|---|---|---|---|
| 3,484,677 | 12/1969 | Piteo | 123/149 A X |
| 4,333,442 | 6/1982 | Wolf | 123/599 |
| 4,336,785 | 6/1982 | Newberry | 123/149 A X |
| 4,351,500 | 7/1985 | Burson | 123/599 X |

FOREIGN PATENT DOCUMENTS

| | | | |
|---|---|---|---|
| 3214866 | 10/1983 | Fed. Rep. of Germany | 123/647 |

*Primary Examiner*—Tony M. Argenbright

*Attorney, Agent, or Firm*—Frishauf, Holtz, Goodman & Woodward

[57] ABSTRACT

A cooling plate, the hybrid electronic circuit and a circuit board connection plate, are mounted flat at the bottom of a cup-shaped vessel with a reentrant tube for an iron core leg, in which vessel the secondary winding on its spool and a primary winding set inside the spool are put for being imbedded in a casting resin. The vessel and its contents fits over the central core leg of an E-shaped stationary armature of a magneto generator for a one-cylinder internal combustion engine.

10 Claims, 7 Drawing Figures

MAGNETO IGNITION UNIT WITH CONTROL CIRCUIT POTTED TOGETHER WITH THE ARMATURE WINDINGS, FOR INTERNAL COMBUSTION ENGINES

This invention concerns a magneto ignition unit with built-in contactless control for internal combustion engines, especially for small engines and one-cylinder engines.

A known magneto ignition unit of this general kind is described in published German Patent Application DE-OS 32 14 866, where the control circuit containing an electronic interrupter element for the primary winding circuit is manufactured according to so-called hybrid technology, in which discrete components are mounted on an integrated circuit unit containing conducting paths and other circuit elements, is located together with a cooling plate of sheet metal in a casing vessel containing the primary and secondary windings of the ignition armature of the unit. The contents of the casing vessel are flooded with a casting resin to form a solid mass.

In order to lead away the heat generated in the electronic interrupter in that device, the cooling plate is disposed with the majority of its cooling surface in the immediate neighborhood of a wall of the casing vessel. The casing vessel is given a special bulging configuration for accomodating the hybrid circuit and the cooling plate. There is a disadvantage in this arrangement because of the disposition of the hybrid circuit with the cooling plate alongside of the secondary winding, which results in an excrescence of the casing vessel requiring an inconvenient amount of space, leading to mounting difficulties where only narrow spaces are available near the part of the engine that must drive the pole wheel of the magneto generator. Furthermore, with this known construction, it is in many cases impossible to use the device as a retrofit replacement for an ignition armature of older design, for example, in a contact-controlled ignition system, in order to obtain the advantages of an ignition armature with integrated contactless control, because the dimensions of the known ignition armature unit are too great.

SUMMARY OF THE INVENTION

It is an object of the present invention to reduce the weight and the volume of an ignition armature with integrated contactless control for use with a conventional magneto generator pole wheel, to such an extent that it will not be necessary to provide an excrescence of the casing vessel for accomodating the hybrid circuit and cooling plate in the same casing vessel as the armature windings. It is a further object of the invention to make it possible to constitute such a device so that a given size of the casing vessel which houses the armature windings will be able to be used with enclosed hybrid circuit units of any of a variety of kinds, i.e., without requiring a change of vessel dimension.

Briefly, the cooling body and the hybrid electronic circuit unit are flat and together have roughly the configuration of an annular disk even when a circuit board connection plate is added, and this annular disk subassembly is then oriented parallel to an end face of the windings near the bottom of the casing vessel, through which a leg of the core passes. It has been found possible to do this without the annular disk subassembly requiring any larger diameter of the casing vessel than the windings themselves. In this way, the dimensions of an ignition armature unit with built in electronic control can be greatly reduced without sacrifice of ability to remove heat from the electronic circuit. Thus, the ignition unit of the present invention can be installed even in narrow quarters and even as a retrofit replacement of the ignition armature of a magneto generator which utilzied interrupter contact control of the ignition armature windings. Thus, interrupter contacts exposed to wear and contamination can be dispensed with. Furthermore, the advantage of weight reduction is also obtained.

The magneto ignition unit of the invention, furthermore, lends itself well to efficient manufacture in a series of steps outlined in essential detail at the end of the specification.

It is particularly advantageous in the construction of the magneto ignition unit of the invention to provide a shallow tublike container in which the hybrid electronic circuit, cooling plate and connection plate can be mounted and then the subassembly snapped on to the coil spool, before insertio into the casing vessel in which they and the coils will be flooded with a casting resin.

The invention contemplates the provision of busbars held in the internal surface of the coil spool of the secondary winding and thus outside of the primary winding, which will pass through holes in the tublike container, circuit unit, cooling plate and connection plate to a place where connections can be soldered before the casing vessel is slipped over the spool and the tublike container. Futher features of the invention will be found in the detailed description that follows.

BRIEF DESCRIPTION OF THE DRAWINGS

The invention is further described by way of illustrative example with reference to the annexed drawings, in which.

DESCRIPTION OF THE ILLUSTRATED EMBODIMENT

Figure 1:
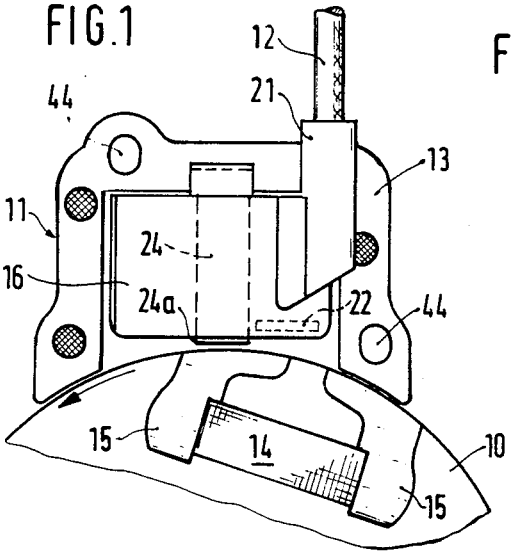
FIG. 1 is an axial side elevation of a magneto ignition unit for an internal combustion engine, with the pole wheel of the magneto generator and its drive broken away.

FIG. 1 shows a magneto ignition unit for a single-cylinder internal combustion engine, consisting of a rotary pole wheel 10, only part of which is shown and which is driven by the engine in a manner not shown in the drawing, and also a stationary unit composed of the ignition armature 11 and associated equipment which will shortly be described. An ignition cable 12 leads from a winding of the armature, further described below, over to a spark plug of the engine not shown in the drawing.

Figure 3:
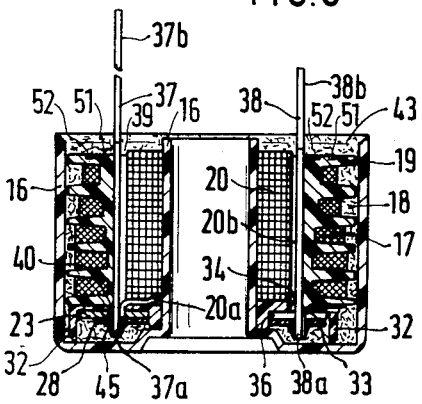
FIG. 3 is the cross section of the casing vessel 16 of FIGS. 1 and 2 containing the windings of the stationary armature on their spools, a cooling body, and a hybrid electronic circuit unit and certain conductive connections, the circuit unit and the cooling body being disposed on an end face of the windings.

The ignition armature 11 has a three legged iron core 13 with a yoke at the top while the bottom ends of the legs are directed to that their ends are separated from the pole wheel periphery by a narrow gap. The ignition armature 11 cooperates with a magnet system of the pole wheel which consists of a permanent magnet 14 and two pole pieces 15 spaced from each other and leading from the respective magnet poles to the periphery of the pole wheel. A primary and a secondary winding, described below in connection with FIG. 3, are disposed around the middle leg 24 of the iron core 13 for generating the ignition energy. They are potted with a casting resin in a casing vessel 16.

FIG. 3 shows a cross section of the casing vessel 16 and its contents. The secondary winding 17 is wound in several chambers 18, located one above the other, in a spool body 19 of insulating material, which concentrically surrounds the primary winding 20 which is constituted as a compact coil. The winding end 17*a* (FIG. 5) of the secondary winding 17, leads to a high-voltage terminal 21 in which is fastened the end of the ignition cable 12 (FIG. 1).

The primary winding 20 is connected to a primary current circuit in which an electronic ignition switch (interrupter) is interposed for having its condition changed from conducting to non-conducting to produce a spark at the instant of the ignition. This change of condition interrupts the primary current circuit and thereby induces a high voltage pulse in the secondary winding 17 which produces a spark at the spark plug of the engine.

Figure 4A:
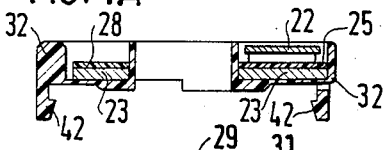
FIG. 4A is a cross-section and FIG. 4B a plan view of a connection plate, with the cooling plate and the hybrid circuit mounted in an annular trough which, when inverted, is to be snapped onto the spool of the secondary winding.
Figure 4B:
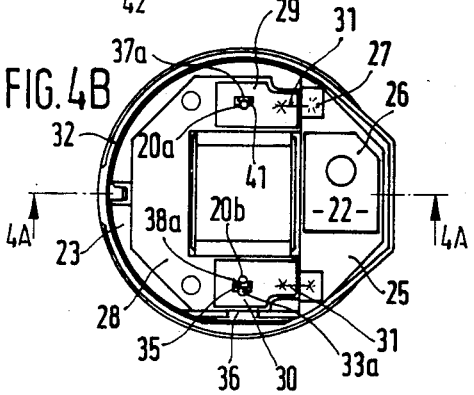

The control of the electronic switch which interrupts the primary circuit is performed by a control circuit supplied with energy from the primary winding voltage. The electronic ignition switch and the control circuit are combined together in a hybrid circuit unit 22 which, as shown in FIG. 4, is placed flat against an end face of the primary and secondary windings 20, 17 which is near the extremity of the middle leg 24*a* of the core 13, while a cooling body 23 likewise flat against an end face of the windings occupies most of the rest of the area of the end face in question.

The hybrid circuit unit 22 has a substrate of aluminum oxide or other ceramic material on which the electronic ignition switch and various circuit elements of the control circuit are fastened with adhesive. These integrated circuit components are interconnected with each other, and with resistances, capacitances and contact surfaces on the insulating substrate, by connection conductors provided in accordance with thick film circuit unit technology. The various elements of the hybrid circuit unit 22 are covered by a varnish layer 25 and a synthetic resin potting compound 26 so that only contact surfaces 27 remain free. The hybrid circuit unit 22 is cemented fast, together with a connection plate 28, on the ring-shaped cooling body 23 made of sheet copper. The connection plate 28 consists of a U-shaped circuit board with two contact surfaces 29 and 30 at its respective ends, which are connected by bonding wires 31 with the respective contacting surfaces 27 of the hybrid circuit unit 22. Cooling body 23, hybrid circuit unit 22 and connection plate 28 are set in a trough 32 of insulating material running around the middle leg 24 of the iron core 13 near its extremity 24*a* which protrudes through the trough. The trough 32 is an individual injection-molded part that is snapped on to the end of the spool 19 of the secondary winding 17.

Figure 6:
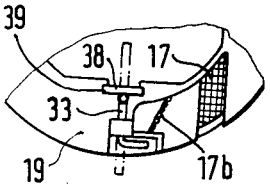
FIG. 6 is a detail showing a cutout of said spool for providing an electrical contact for an end of the secondary winding.

The ends 20*a* and 20*b* of the primary winding 20 and the beginning 17*b* of the secondary winding 17 extend out of the windings' lower end face for making contact with the hybrid circuit 22. As FIG. 6 shows, the beginning 17*b* of the secondary winding 17 makes contact with a lead wire 33 which is fastened on the end of the spool 19 and has one end 33*a* for making contact with the contact surface 30 of the connection plate 28 after passing through a bottom opening 34 of the trough 32 and aperture 35 of the connection plate 28 within the contact surface 30. In the region of the aperture 35, the underlying cooling body 23 is provided with a slot 36 in order to inhibit the generation of eddy currents in the cooling body 23. The end 20*b* of the primary winding 20 also protrudes through the bottom opening 34 and the aperture 35 in order to connect with the contact surface 30.

Figure 2:
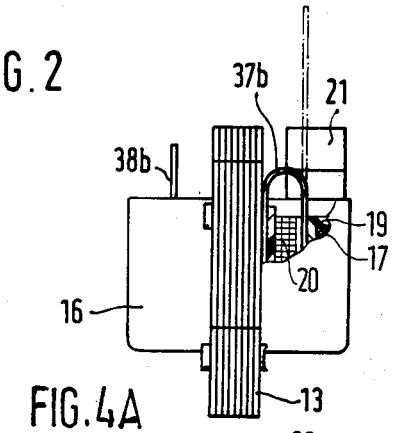
FIG. 2 is an end view of the stationary armature portion of the unit of FIG. 1 seen from the left of FIG. 1

The spool 19 on which the secondary winding 17 is wound carries two busbars 37, 38 on its internal surface, which as shown in FIG. 3, are each guided in a longitudinal groove 39 in the internal surface of the spool. The first busbar 37 protrudes through a bottom opening of the trough 32, a hole 40 of the cooling body 23 and a further aperture 41 of the connection plate 28 within the contact surface 29, so protruding with its lower end region 37*a* together with the end 20*a* of the primary winding for making contact with contact surface 29. The upper end 37*b* of the busbar 37 is, as shown in FIG. 2, bent inwards and becomes a ground connection for the primary and secondary windings at the middle core leg 24 where it is clamped in place upon pushing the casing vessel 16 into place.

The second busbar 38 serves for the connection of a stop switch not shown in the drawing. Its upper end 38*b* protrudes out of the casing container 16 as a connection terminal or connection prong. Its lower end 38*a* passes through the bottom opening 34 of the trough 32 and through the aperture inside the contact surface 30 in order to make contact with the contact surface 30. The making of contact by the primary and secondary leads, and by the busbars at the contact surfaces 29 and 30, is completed by soldering 45 at the apertures 35 and 41.

In the manufacture of the stationary ignition armature and its associated equipment, the secondary winding 17 is first wound on the spool 19, and the end 17*b* thereof is connected with the lead wire 33. The ends of the lead wire 33 are then bent into the desired position, after which the busbars 37 and 38 are set in the corresponding longitudinal grooves 39 of the spool 19.

Thereafter, the separately wound primary winding 20 is set inside the spool 19 and the trough 32 which carries a preassembled unit composed of a cooling body 23, the hybrid circuit 22 and the connection plate 28 connected thereto, is then clipped or snapped onto the lower end face of the spool 19 by means of catch members 42. This assembly, set in the casing 16, with the busbar ends 37*b* and 38*b* only partly formed, is shown in top view in FIG. 5, showing the grooves 51 and 52 in the spool top, which are of no importance.

Before the spool and its assembled parts are put in casing 16, the busbar ends 37*a* and 38*a*, as well as the ends 20*a* and 20*b* of the primary winding 20, and the connecting wire 33 for the secondary winding 17, are soldered at the apertures 35 and 41 with the respective contact surfaces 29 and 30, the connection to the winding end 17*b* being made through the intermediary of the connection wire 33.

Figure 5:
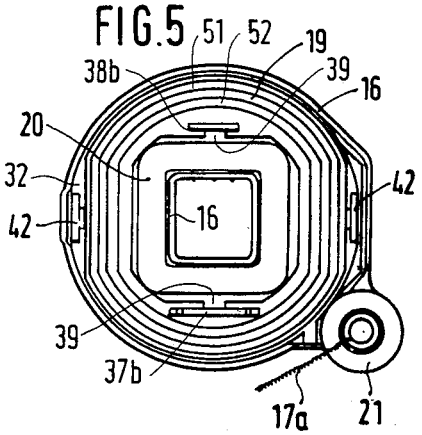
FIG. 5 is a top view of the primary, winding, the spool of the winding and the re-entrant cup-shaped casing in which they are to be potted.

The subassembly thus constituted is then set into the casing vessel 16 and the end 17*a* of the secondary winding 17 is introduced into the high voltage terminal 21 and there connected with the ignition cable 12, as shown in FIG. 5, When this point is reached, all components in the casing vessel 16 are completely flooded with a casting resin 43. The end 37*b* of the busbar 37 is bent inwards and the casing container 16 is pressed onto the middle leg 24 of the previously completed laminated iron core 13.

Two elongated holes 44 of the iron core 13 now permit the ignition armature 11 to be screwed fast in a restricted space at the selected location of the engine block or housing. The ignition armature 11 can also be used to replace a previously used ignition armature designed for control by interrupter contacts. Since the ignition armature 11 according to the invention already contains an electronic ignition interrupter controlled in a contactless way, in this case, the mechanical interrupter of the replaced ignition armature unit can also be discarded.

Although the invention has been described with reference to a particular illustrative example, it will be understood that variations and modifications are possible within the inventive concept.

We claim:

1. Magneto ignition unit for an internal combustion engine comprising a magneto generator arranged to be driven by said engine, said magneto generator having a rotary pole wheel and a stationary ignition armature having an iron core, around a leg of which a primary and a secondary winding are wound, a high voltage terminal for connecting said secondary winding to at least one spark plug of said engine, and a re-entrant cup-like vessel surrounding said leg of said core and said windings, said leg of said core having an extremity protruding through said vessel and said vessel having a cooling body and a hybrid electronic circuit unit potted therein together with said primary and secondary windings, said cooling body and hybrid electronic circuit unit, according to the invention, being flat and oriented parallel to an end face of said windings in the neighborhood of the extremity of said leg of said core.

2. Magneto ignition unit according to claim 1, in which a trough of insulating material runs around at least a major part of said core leg within said re-entrant cup-like vessel with the trough bottom backed against said end face of said windings, a connection plate being affixed in common with said hybrid switching circuit on said cooling body within said trough, and said leg of said iron core protruding through a central aperture in said trough.

3. Magneto ignition unit according to claim 2, in which said connection plate consists of a flat U-shaped circuit board and two contact surfaces at the respective ends of said U-shaped circuit board, said contact surfaces being connected with said hybrid circuit unit and having first and second apertures at which connection leads of said primary and secondary windings, at least one of which is extended by a bonding wire, pass for making connection to said contact surfaces.

4. Magneto ignition unit as defined in claim 3, in which a spool is provided on which said secondary winding is wound, said spool having on the surface of a central passage therethrough, longitudinal grooves in which two oppositely located busbars are carried by said spool, an ends of the respective busbars passing through said apertures of said connection plate for making contact with said contact surfaces.

5. Magneto ignition unit as defined in claim 4, in which each of said busbars has an end remote from the respective contact surface of said connection plate, a first of said busbars having said remote end serving as a ground connection to said core of said armature and a second of said busbars having a said remote end thereof serving as a connection for a stop switch, and protruding out of said vessel.

6. Magneto ignition unit according to claim 5, in which a connecting wire is provided, fastened at one end to a beginning end of said secondary winding, said connecting wire being affixed to the lower end face of said spool, and protrudes at one end into a said aperture of said connection plate for making contact with one of said contact surfaces.

7. Magneto ignition unit according to claim 6, in which said primary winding is seated within said spool concentrically with said secondary winding, and has ends respectively making contact with said contact surfaces and passing through the respective apertures in said connection plate.

8. Magneto ignition unit according to claim 7, in which a solder joint is provided at said apertures of said connection plate for providing good electrical contact of the respective busbars and of the respective connection leads and connecting wire of said windings.

9. Magneto ignition unit according to claim 2, in which said trough is a separate synthetic plastic part snapped onto said end face of said spool, and is provided with registering openings in the respective regions of said apertures of said connection plate.

10. Method of producing a magneto ignition stationary armature unit for an internal combustion engine comprising the steps of:

producing a laminated iron core having a leg surrounded by clearance for the provision of coils around said leg and also a spool for the secondary coil which leaves space inside thereof for fitting a primary coil between said spool and said leg and has diametrically opposite longitudinal grooves on its inside surface for positioning busbar conductors;

winding said secondary coil on said spool, equipping a first end thereof with a connecting wire, leaving one end of said connecting wire free; and bending the free end of said connecting wire in a predetermined configuration and position at one end-face of said spool, a second end of said secondary coil being made accessible at the opposite end-face;

setting said busbar conductors in said grooves of said spool;

separately winding said primary coil in annular block form and setting it in position inside said spool, with its ends freely accessible at one end-face of said coil;

producing a tub-like container of insulating material for retaining in place a subassembly comprising a cooling plate, a hybrid circuit unit made on a substrate plate and a connection plate of circuit board construction together having roughly the configuration of an annular disk, said tub-like container having diametrically opposite apertures, said container having holes in its tub-bottom for registering with said apertures and a central aperture for passage of at least said core leg;

assembling said subassembly on the inside of said tub-like container;

fitting said container with said subassembly therein on the end face of said spool and of said primary coil at which said primary coil ends are accessible and completing the fitting operation in a catch-held manner utilizing catch elements provided at least in part by the configuration of said spool and, in so doing, causing said busbar conductors to pass through said holes and apertures;

bringing said ends of said primary coil into position for connection with said busbar conductors;

perfecting the electrical connectors at the respective ends of said busbar conductors with said primary coil ends, said connecting wire of said secondary coil end and said connection plate;

putting the held-together spool and tub-like container, together with other components held thereon and therein, into place in the annular contained space of a cup-like vessel having a reentrant tubular part for fitting said iron core leg and also an integral high voltage terminal holder on its periphery;

connecting said second end of said secondary coil to an externally leading ignition cable within said high voltage terminal holder;

flooding the contents of said cup-like vessel with a casting resin and allowing said resin to solidify;

bending the protruding end of one of said busbar conductors in a predetermined configuration for grounding contact with said core leg, and pressing said cup-like vessel and its contents onto said core leg until said core leg has passed therethrough and protrudes from the bottom of said vessel, and at the same time said grounding contact of said busbar conductor and said core is established.

* * * * *